US005197660A

United States Patent [19]

Colling

[11] Patent Number: 5,197,660

[45] Date of Patent: Mar. 30, 1993

[54] TWIN PACKAGE CARTON

[75] Inventor: Keith J. Colling, Brownsburg, Ind.

[73] Assignee: Inland Container Corporation, Indianapolis, Ind.

[21] Appl. No.: 880,305

[22] Filed: May 5, 1992

Related U.S. Application Data

[63] Continuation-in-part of Ser. No. 765,851, Sep. 9, 1991, abandoned.

[51] Int. Cl.[5] ..... B65D 5/54

[52] U.S. Cl. ..... 22.9/120.011; 493/63; 493/114; 493/183

[58] Field of Search ..... 229/120.11, 120.01, 229/120.011; 493/59, 63, 114, 183, 394

[56] References Cited

U.S. PATENT DOCUMENTS

| | | | |
|---|---|---|---|
| 2,046,751 | 7/1936 | Reichel | 229/37 |
| 2,327,529 | 8/1943 | Kieckhefer et al. | 229/15 |
| 2,361,650 | 10/1944 | Potts | 229/120.11 |
| 2,634,041 | 4/1953 | Burnett | 229/23 |
| 2,651,449 | 9/1953 | Burnett | 229/23 |
| 2,672,275 | 3/1954 | Rudine | 229/120.011 |
| 2,686,000 | 8/1954 | Berke | 229/28 |
| 2,737,334 | 3/1956 | Halgren | 229/120.01 |
| 2,973,130 | 2/1961 | Cottrill | 229/120.011 |
| 3,099,380 | 7/1963 | Nathan | 229/27 |
| 3,101,880 | 8/1963 | Peterson | 229/15 |
| 3,158,312 | 11/1964 | Simkins | 229/120.011 |
| 3,315,457 | 6/1964 | Risucci | 229/120.011 |
| 3,365,109 | 1/1968 | Kessler et al. | 229/15 |
| 3,677,458 | 7/1972 | Gosling | 229/27 |
| 4,083,879 | 4/1978 | Capo | 206/623 |
| 4,377,237 | 3/1983 | Pawlowski | 229/120.011 |
| 4,467,923 | 8/1984 | Dornbusch et al. | 206/602 |

*Primary Examiner*—Gary E. Elkins
*Attorney, Agent, or Firm*—Fitch, Even, Tabin & Flannery

[57] ABSTRACT

Disclosed is a twin-package carton having a pair of separable carton components separably joined side-by-side. Connecting tabs of one carton component are secured to the other carton component with an adhesive and are severable along lines of perforation.

13 Claims, 6 Drawing Sheets

TWIN PACKAGE CARTON

This application is a continuation-in-part of application Ser. No. 07/756,851 filed Sep. 9, 1991, abandoned.

BACKGROUND OF THE INVENTION

1. Field of the Invention

The present invention pertains to paperboard cartons, and in particular to cartons having separate, divisible compartments.

2. Description of the Related Art

Attempts have been made to provide a divisible package, one having multiple compartments which are separable one from the other. For example, U.S. Pat. No. 3,101,880 discloses a carton formed from an integral blank which has two compartments side-by-side, which are joined together. The two compartments are covered by flaps which are common to both compartments. Medial portions of the carton sidewalls are slotted throughout their entire height, with the slots extending partly into the upper and lower closure flaps. Thus, the slots extend partly into the top of the completed carton and partly into the bottom of the completed carton. To divide the compartments of the carton, the top and bottom portions of the carton are cut between the ends of the slots. Although mention is made that perforations could extend between the slot ends, such perforations are not desired because of the possibility of a premature rupture of the carton compartments if the carton is roughly handled. Thus, a user would have to cut both the top and bottom of the carton and a reduction of this effort in separating the compartments is desired. Also, after the carton compartments are cut apart, each resulting compartment has an upper end secured with only three overlapping flaps, on three of the four sidewalls of the resulting carton compartment. Thus, one side of the carton is left exposed at its upper corner. While this may not present a particular problem for packaging canned goods, other applications are more demanding and complete sealing of the carton is sometimes required. Further, the carton blank of U.S. Pat. No. 3,101,880 does not lend itself to economical automated fabrication and improvements in the fabrication of cartons, leading to cost reductions, are becoming increasingly essential if a marketing advantage is to be maintained.

U.S. Pat. Nos. 3,099,380 and 3,677,458 each disclose a pair of completely formed cartons joined together by a single line of perforation formed in a panel which is common to both cartons. However, these cartons are directed to users having specialized requirements and are not suitable for broader applications. For example, U.S. Pat. No. 3,677,458 has an upper end with carrying handles formed in the top wall of the carton, that wall perforated for subsequent division of the carton into two half portions. Dust intrusion is not an important factor since striking of the handles out of the plane of the upper compartment wall exposes the contents of the carton to dust intrusion. Further, flaps for filling and emptying the carton are located on the endwalls of the carton, an arrangement which is sometimes not desired.

U.S. Pat. No. 2,327,529 discloses a pair of cartons joined side-by-side by lines of perforation formed in a panel common to both cartons. The lines of perforation are formed on two opposed sidewalls of the carton requiring the connected compartments to be severed at the line of perforation, with a cutting instrument or the like, since it would be difficult to tear the compartments apart.

U.S. Pat. Nos. 2,634,041 and 2,651,449 have partially overlapping top flaps for securing separately formed carton compartments together. The overlying flaps are of irregular configuration and are not believed to be suitable for economical automated fabrication.

U.S. Pat. Nos. 2,046,751; 2,686,000; 3,365,109; 4,083,879; and 4,467,923 are directed to divisible cartons of irregular special-purpose construction, unsuitable for general purpose use.

Improved carton constructions and methods of fabrication, which overcome the deficiencies above and other deficiencies in prior art visible cartons are still being sought.

SUMMARY OF THE INVENTION

It is an object according to the present invention to provide a divisible carton, having two or more compartments joined together by a line of perforation, which can be torn apart to form separate carton constructions.

Another object according to the present invention is to provide a divisible carton of the above-described type formed from two identical carton members which can be economically joined together to form a multiple compartment carton assembly.

A further object according to the present invention is to provide an improved method of fabrication of cartons of the above-described types.

These and other objects according to the present invention which will become apparent from studying the appended description and drawings are provided in a carton apparatus, comprising:

first and second compartment members each having a plurality of sidewalls, bottom flaps and top flaps and defining a substantially enclosed interior volume;

said first and second compartment members each comprising a tab extending from a top flap and joined thereto with a line of weakness so as to be manually severable therefrom;

the tab of one compartment member overlying a top flap of the other compartment member and secured thereto with securement means; and the lines of weakness of the first and second compartment members, being aligned end-to-end.

Other objectives are accomplished by a method according to the present invention, comprising the steps of:

providing first and second compartment members, each with a plurality of sidewalls, bottom flaps and top flaps and defining a substantially enclosed interior volume;

providing each of the first and second compartment members with a tab extending from a top flap and joining the tab to the top flap with a line of weakness so as to be manually severable therefrom;

arranging the first and second compartment members so that the tabs of one compartment member extend toward the other compartment member and so that first sidewalls of the first and second compartments are mutually opposing;

bringing the mutually opposing sidewalls of the first and second compartment members adjacent one another so that the tab of one compartment member overlies the other compartment member; and securing the tab of one compartment member to the other compartment member so as to join the two compartment members together along the lines of weakness to form said carton apparatus.

DETAILED DESCRIPTION OF THE PREFERRED EMBODIMENT

Figure 9:
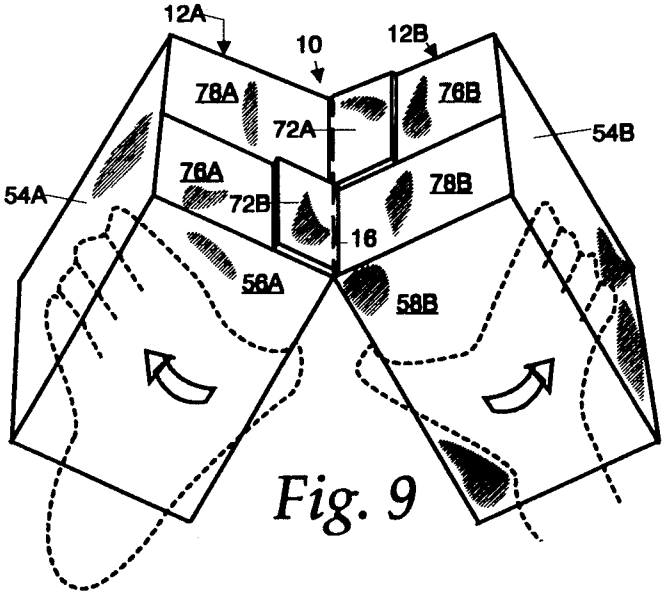
FIG. 9 is a perspective view of the carton assembly indicating the manner of separation of the carton components.

Referring now to the drawings and initially to FIGS. 1–5, a carton assembly 10, according to principles of the present invention is shown. The carton assembly is comprised of two carton components **12*a*, 12*b* joined together along a line of perforation 16. Preferably, the two carton components 12*a*, 12*b* are substantially identical to one another and are held together by connecting tabs 72*a*, 72*b* (see FIG. 9) which are secured to the top closure flaps 76 of the other carton with a suitable means such as staples or other mechanical fasteners, but preferably a suitable adhesive. The cartons are readily separated from one another along the line of perforation 16, as indicated in FIG. 9**. After separation, each carton component remains sealed, and in effect, comprises a separate, independent sealed carton. Further, the appearance of each carton component is suitably attractive for merchandising and display in a separated condition.

Figure 16:
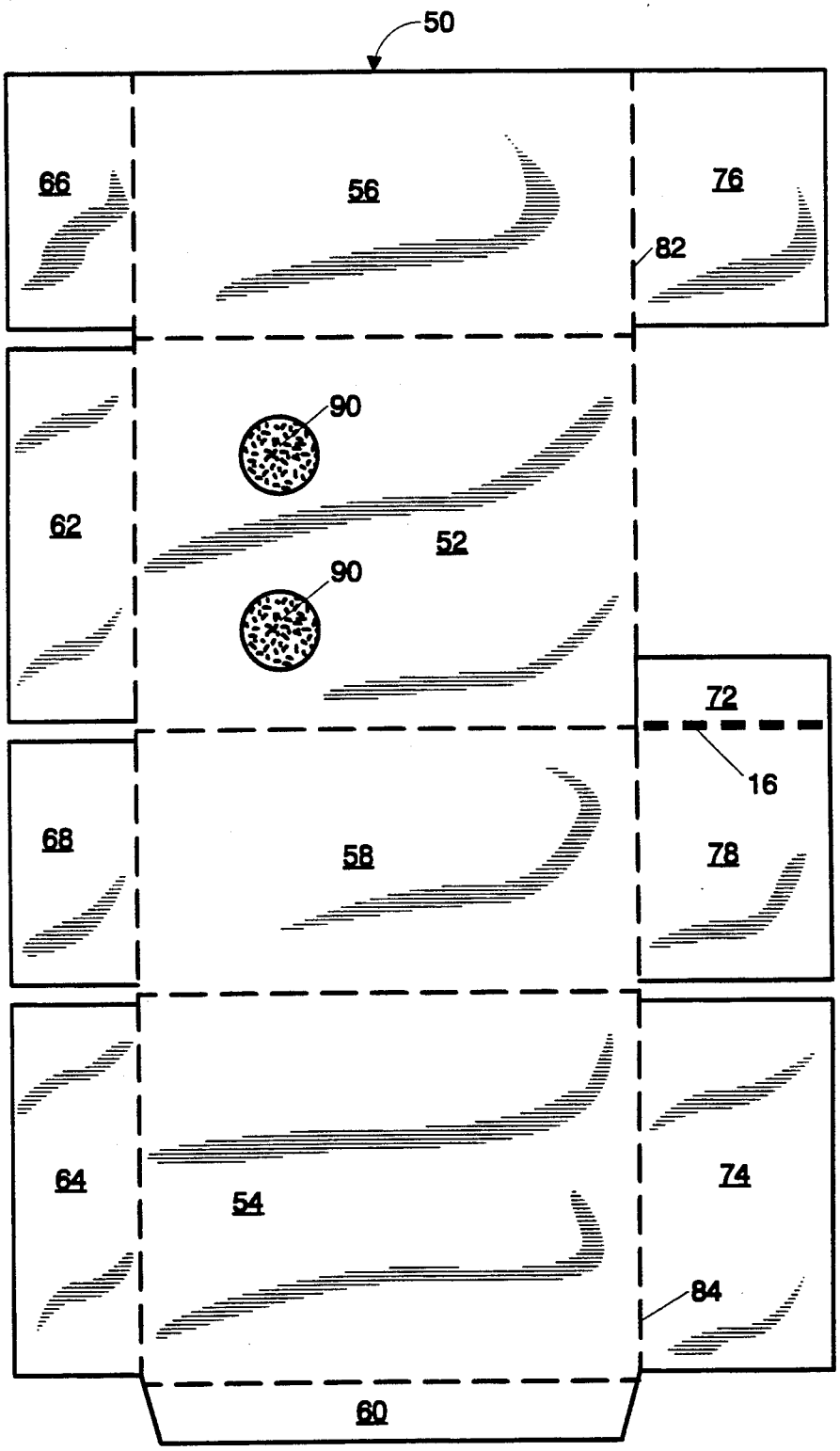
FIG. 16 is a top plan view of a blank used to construct the carton components of the carton assembly.

As mentioned, the carton components **12*a*, 12*b* are preferably identical to one another, and with reference to FIG. 16, a blank 50 for forming the carton components is illustrated. The blank 50 has a central section formed by the serial succession of a sidewall 56, a major sidewall 52, a minor sidewall 58 of dimensions similar to that of sidewall 56, and a second major sidewall 54 of proportions similar to those of the aforementioned major sidewall 52. A manufacturer's flap 60 completes the serial succession of the panels formed at the central portion of blank 50. Bottom closure flaps 62–68 extend from a common side of sidewall panels 52–58, respectively. According to one aspect of the present invention, full-sized closure flaps are formed to extend only from three of the four sidewall panels of the carton blank. That is, top closure flaps 74–78 extend from sidewall panels 54–58, respectively. A connecting tab 72, of smaller size than the top closure flaps 74–78, is attached to the remaining sidewall panel 52**.

According to another aspect of the present invention, the connecting tab 72 is joined to its neighboring top closure flap 78 by a line of weakness such as scoring, but preferably a line of perforation 16. The serial succession of panels 52–60 are joined to one another by hinge or fold lines and the bottom closure panels 62–68 are joined to respective sidewall panels also by a fold or hinge line, which preferably is unbroken and of linear configuration.

According to another aspect of the present invention, the top closure flap 76 is joined to sidewall panel 56 by a fold or a hinge line 82. The top closure flaps 74, 78 are joined to sidewall panels 54, 58 by a common fold or hinge line 84, which is preferably colinear with the fold line 82. The connecting tab 72 is also preferably joined to its neighboring sidewall panels 52 by the fold line 84, although as can be seen in FIG. 16, there is a substantial gap between the connecting tab 72 and the neighboring top closure flap 76.

As can be seen from the above, the preferred configuration of the carton components **12*a*, 12*b*** is generally rectangular, with opposing sidewalls of the carton being of generally similar size and configuration. However, as will be appreciated by those skilled in the art, upon examining the description the drawings, the present invention also contemplates the joinder of carton components having any number of sidewall panels with opposing sidewall panels of the carton components carrying the connecting tabs being substantially in contact with one another. Thus, the carton components could comprise octagonal or hexagonal cartons having octagonal or hexagonal end closures, for example. Also, if desired, an hexagonal carton could be joined to a rectangular carton and such, may be desired for aesthetic considerations in certain applications.

Turning now to FIGS. 1–7, two carton components **12*a*, 12*b* are joined together to form a completed carton assembly 10. FIG. 8 shows the carton component 12*a* separated from its neighboring carton component 12*b*. As can be seen in FIG. 8, the carton component 12*a* has opposing sidewalls 56*a*, 58*a* at the minor sidewall dimensions, and opposing sidewalls 52*a*, 54*a* at the major side surfaces of the carton component. Three top closure flaps 74*a*–78*a* enclosure the upper surface of the carton. A line of perforation 16*a* is located to one side of top closure flap 78*a*, the connecting tab 72*a* of carton component 12*a* having been separated from the carton component. With reference to the right-hand portion of FIG. 8, the connecting tab portion 72*b* remains affixed to top closure flap 76*a*, having been separated from the carton component 12*b***.

Figure 1:
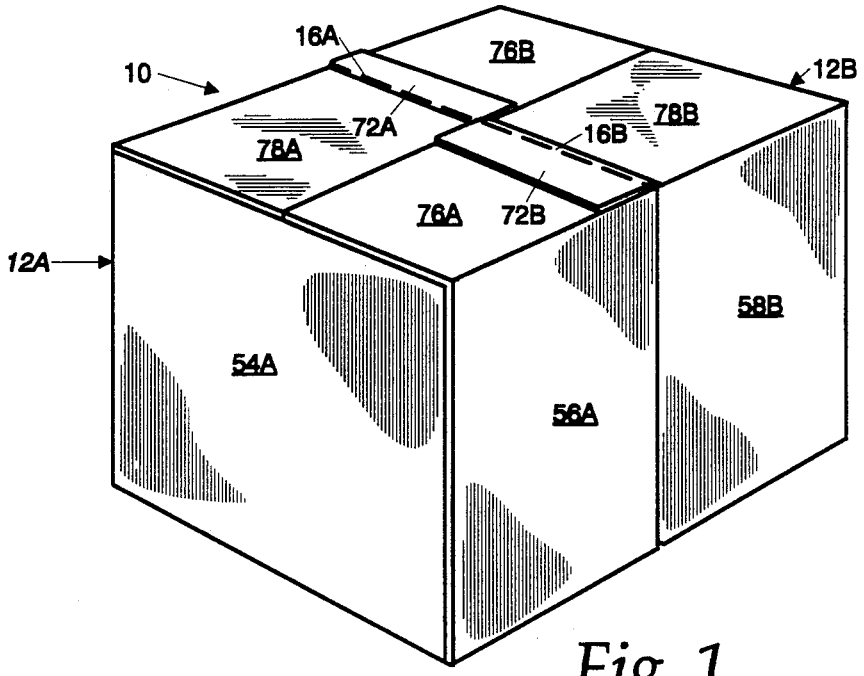
FIG. 1 is a perspective view of a sealed carton assembly constructed according to principles of the present invention.
Figure 2:
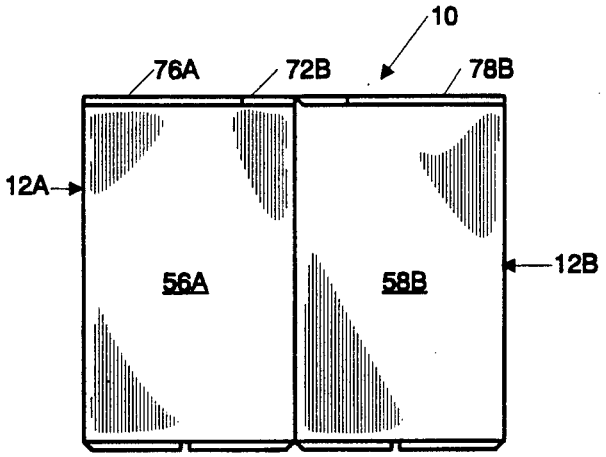
FIG. 2 is a front elevational view thereof.
Figure 3:
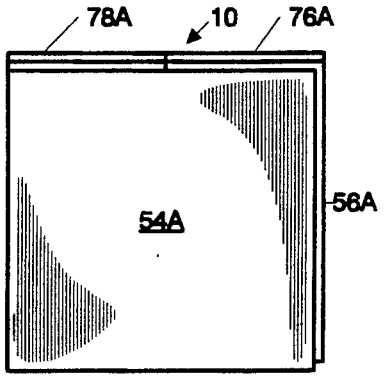
FIG. 3 is an end elevational view thereof.
Figure 4:
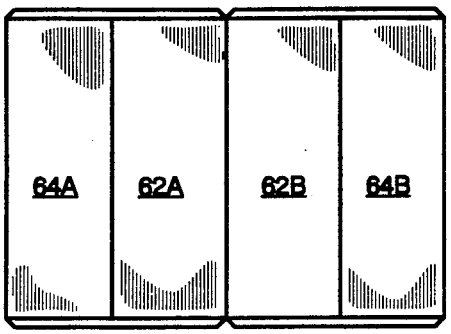
FIG. 4 is a bottom plan view thereof.
Figure 5:
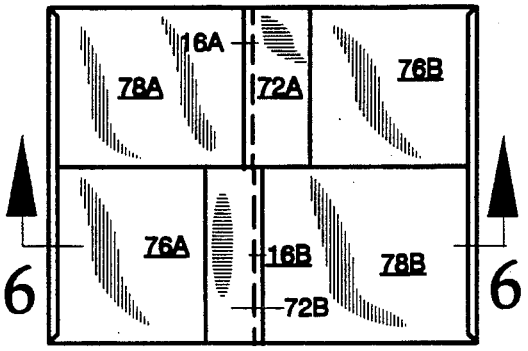
FIG. 5 is a top plan view thereof.

With reference to FIGS. 1–7, although the carton components **12*a*, 12*b* are preferably substantially identical to one another, the carton components are preferably rotated about a vertical axis for marrying or joinder in the manner indicated in FIG. 1, for example. Thus, with reference to the right-hand portion of FIG. 1, the face of carton assembly 10 is made up of adjacent sidewall panels 56*a*, 58*b*. In this manner, the connecting tab 72*a* of carton component 12*a* overlies a carton component 12*b*. In a similar manner, the connecting tab 72*b* of carton component 12*b* overlies carton component 12*a* and as mentioned, is preferably joined thereto with a suitable adhesive. With further reference to FIG. 5, it can be seen that the connecting tabs 72 of the respective carton components are joined to the top closure flaps 76** of the neighboring carton component. The lines of perforation associated with each connecting tab are butted end-to-end and are preferably colinearly aligned one with another so as to form a single line of weakness. The present invention contemplates that lines of weakness other than perforation be used to secure the connecting tabs to their respective carton components. For example, the lines of weakness may be formed by scoring the carton blank, if desired.

With reference to FIG. 4, it can be seen that the bottom closure flaps 62*a*, 64*a* and 62*b*, 64*b* are preferably oriented in parallel directions, and it is generally preferred that the directions of corrugation of the closure flaps be similarly aligned to provide shipping and handling advantages.

Figure 6:
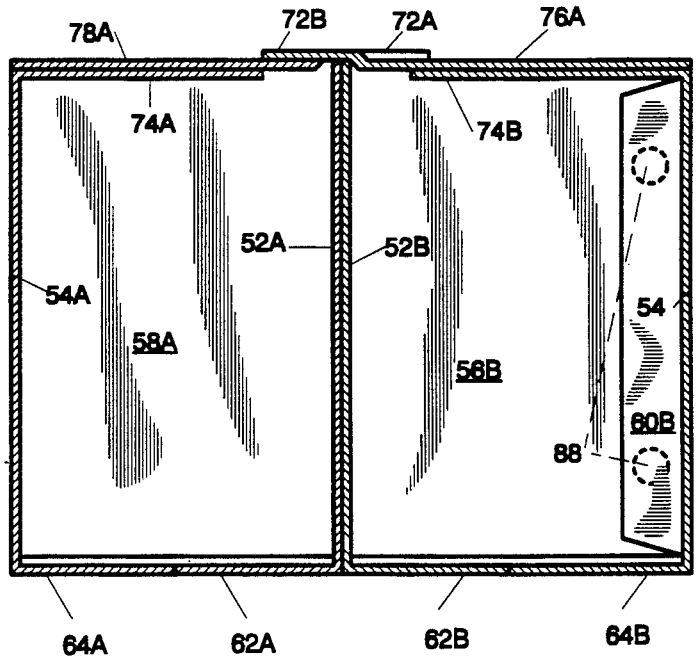
FIG. 6 is a cross-sectional view thereof taken along the lines 6—6 of FIG. 5.

With reference to FIG. 6, the carton assembly 10 is shown in a cross-sectional view taken along the line 6—6 of FIG. 5. The manufacturer's flap 60*b*, visible in FIG. 6, is shown secured to carton sidewall 56*b* with adhesive portions 88, although a continuous strip of adhesive or other alternative adhesive configurations could be employed as well, if desired.

Figure 7:
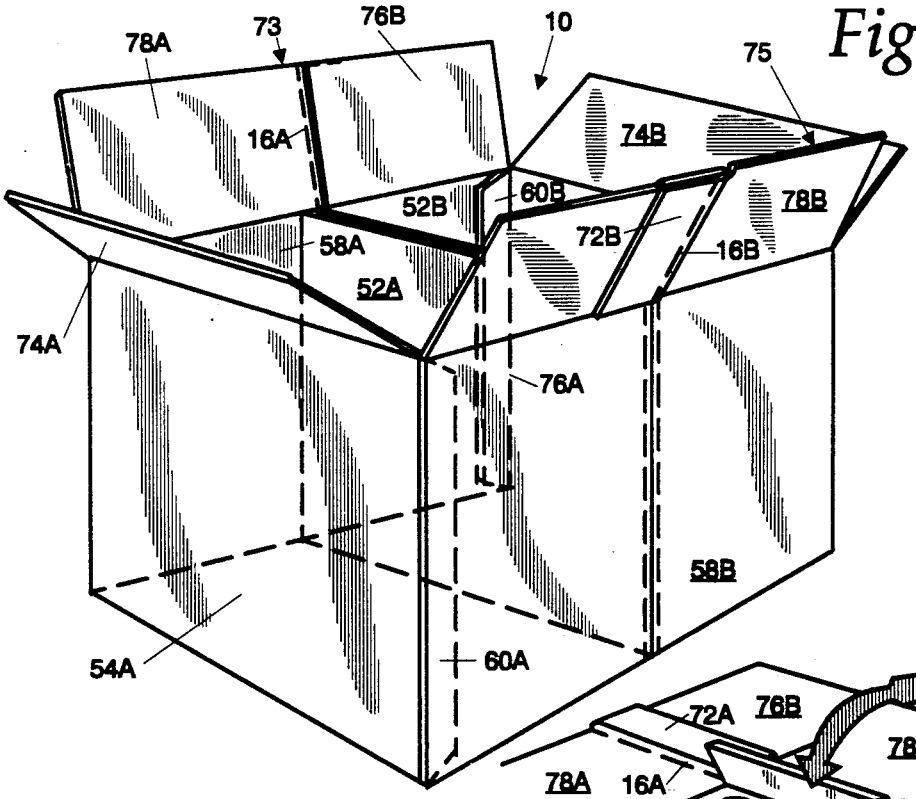
FIG. 7 is a perspective view thereof shown with the top cover flaps in an open position.
Figure 8:
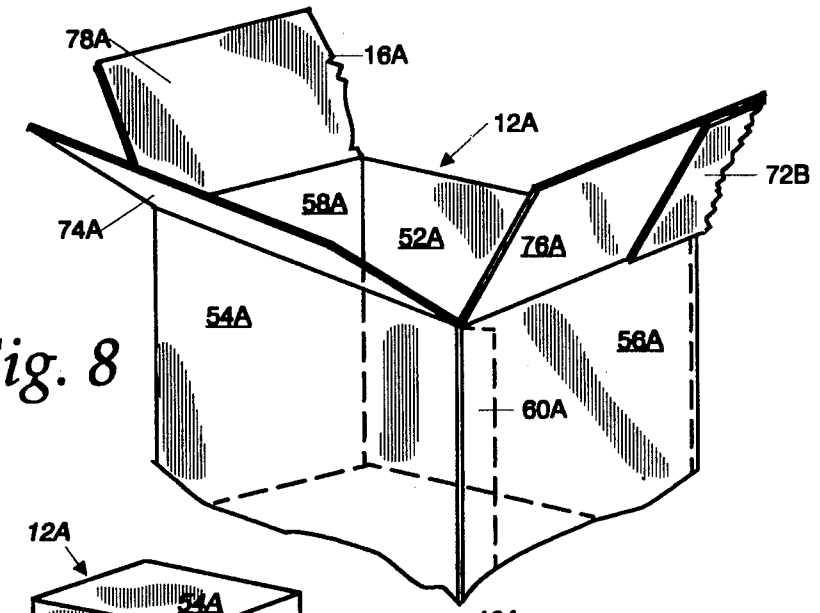
FIG. 8 is a perspective view of a single carton component of the carton assembly.
Figure 17:
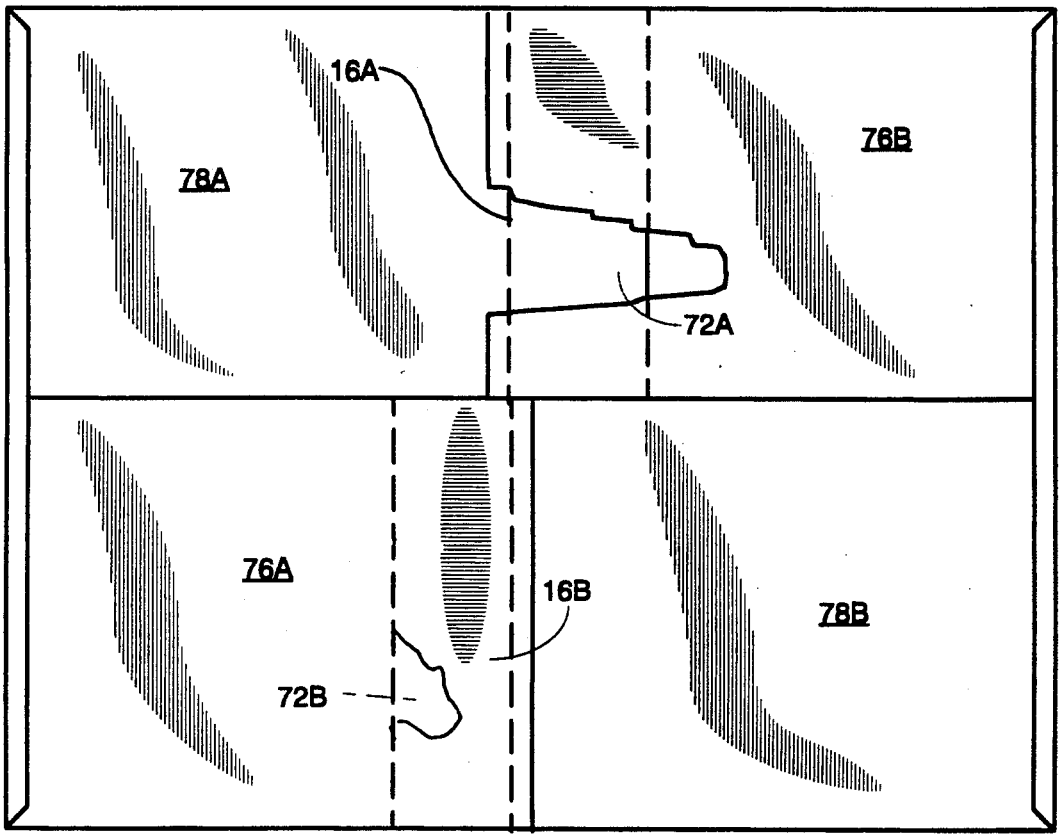
FIG. 17 is a top plan view, shown partly broken away, of an alternative embodiment of a sealed carton constructed according to principles of the present invention.

Turning now to FIG. 7, a completed carton assembly 10 is shown prior to sealing the top closure flaps. As can be seen, the opposing sidewall panels 52*a*, 52*b* are preferably butted one against the other, and if desired may be secured or "tacked" together by adhesive portions 90 indicated in FIG. 16, and located adjacent the bottom portion of the carton assembly. When employed, the adhesive portions 90 are preferably of a low tack adhesive or of such small size that they are readily broken when the carton components are pried apart in the manner illustrated in FIG. 9, preparatory to tearing along the line of weakness 16. As will be appreciated by those familiar with the automated carton filling art, the completed carton assembly 10, as illustrated in FIG. 17, is readily adaptable for automated or mechanized procedures with the opposing sidewalls 52*a*, 52*b*, even if not joined together by adhesive 90 or the like, being held in close contact with one another so as to eliminate any voids therebetween through which product may be lost during a filling operation. The close butting joinder of the opposed sidewalls 52*a*, 52*b* is provided, for the most part, by the connecting tabs 72 located at the top closure flaps. It can now be seen that the connecting tabs 72 form two opposed top closure means 73, 75 extending between opposed sidewalls 54*a*, 54*b* of apparatus 10.

Figure 15:
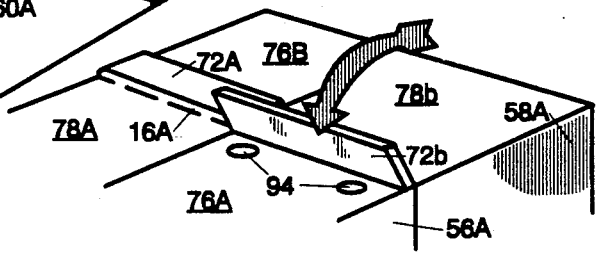
FIG. 15 is a fragmentary perspective view of the upper portion of the carton showing certain assembly steps in greater detail.

After the carton assembly is filled, the top closure flaps 74, 74*b* are closed, and thereafter the remaining top closure flaps are lowered into position, and secured to the top closure flap 74 with a suitable adhesive. Although less preferred, the carton components could be individually filled and sealed and then butted together in the manner indicated in FIG. 15, with the connecting tab 72 being secured to respective top closure flaps 76 by adhesive portions 94. Such an arrangement may be desired where the product associated with each carton assembly is to be kept carefully separate from one another to prevent mixing or inadvertent contact of the product contained in each carton component. However, as mentioned, it is generally preferred that the carton components be joined together prior to filling, in the manner illustrated in FIG. 7.

Figure 10:
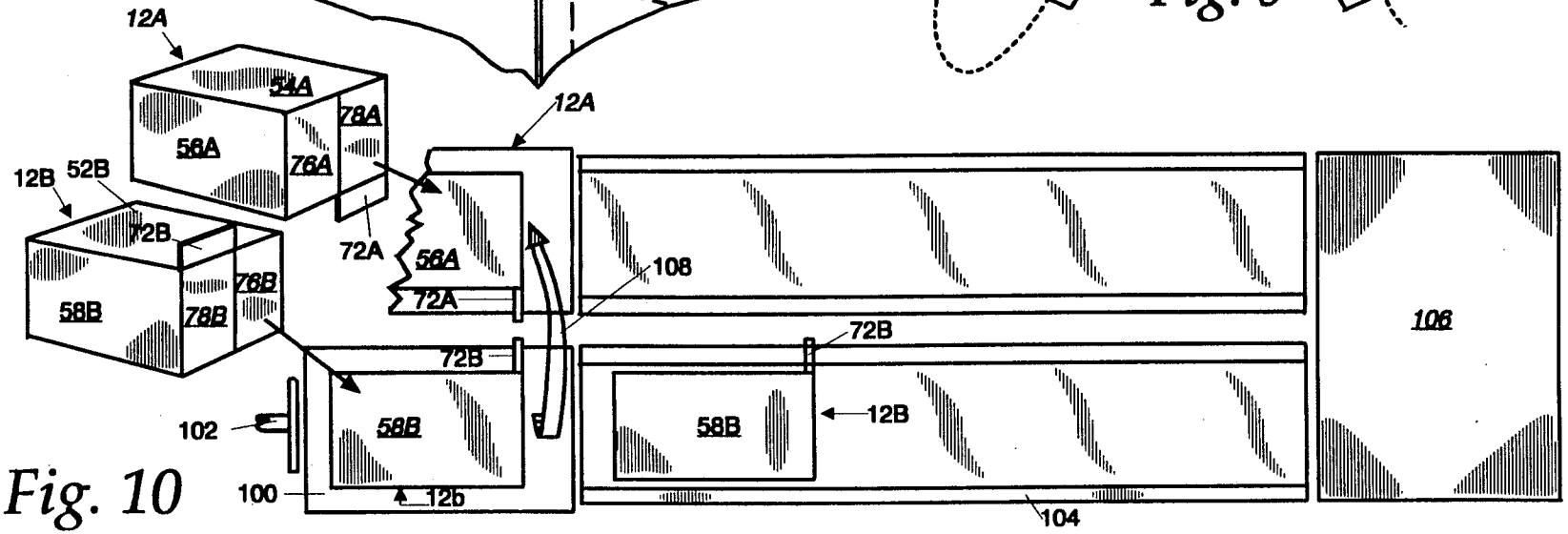
FIGS. 10–14 are schematic illustrations indicating the method of assembly of the carton construction.

With reference now to FIGS. 10–14, assembly of the completed carton 10 will now be described. Referring to FIG. 10, an inlet station 100 is located near the outlet of a conventional carton forming station which includes a ram 102 for pushing a completed carton component 12 to the inlet station 100. The carton is then advanced along a channel 104 to a final assembly station 106. As mentioned above, it is generally preferred that the carton components 12*a*, 12*b* of a completed carton assembly be substantially identical, although one carton component is rotated with respect to the other for the inner fitting joinder illustrated in FIG. 1, for example. It is generally preferred that a single carton forming station be used to form both carton components. Accordingly, with reference again to FIG. 10, a carton fed to the input station 100 is rotated in the manner indicated by arrow 108 to assume the position at the upper left-hand corner of FIG. 10, which is inverted such that the previously upwardly facing side panel 58 is now downwardly facing in contact with the support surface of the input station.

Figure 11:
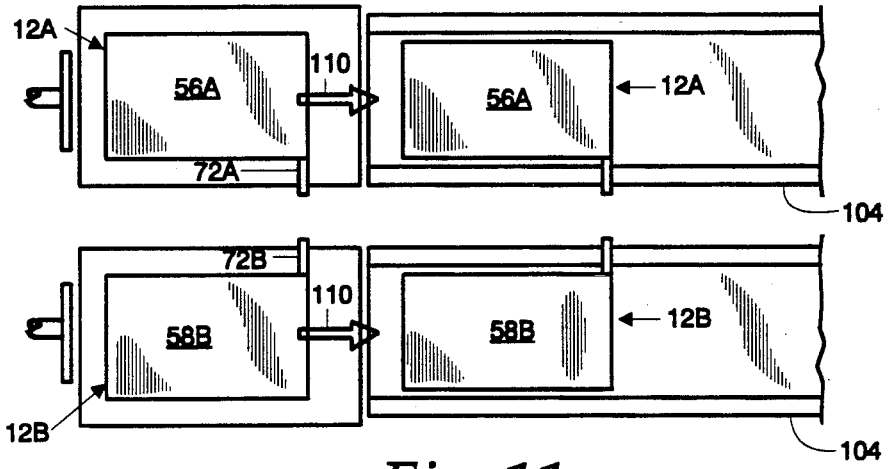
Figure 12:
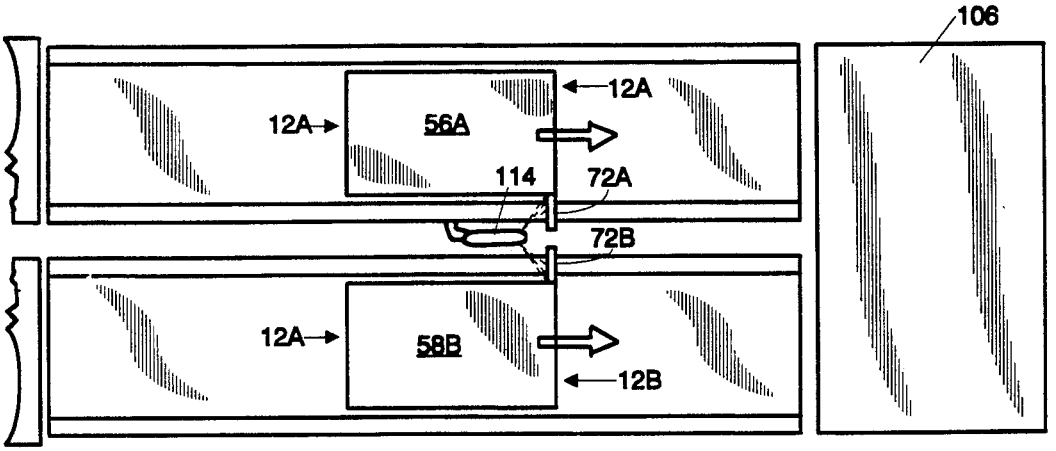

As indicated in FIG. 11, a pair of carton components are associated one with another after inversion, and travel in channels 104 in a downstream direction of arrows 110. As illustrated in FIG. 12, the connecting tabs 72 are located opposite one another and pass a glue applicator device 114 which applies adhesive to the connecting tabs 72. The device 114 may be of a spray type or pressure roller type, for example. After the application of a suitable adhesive to the connecting tabs, the carton components are advanced toward the final assembly station 106.

Figure 13:
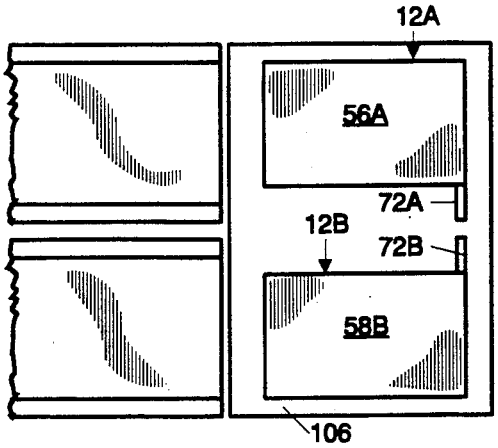
Figure 14:
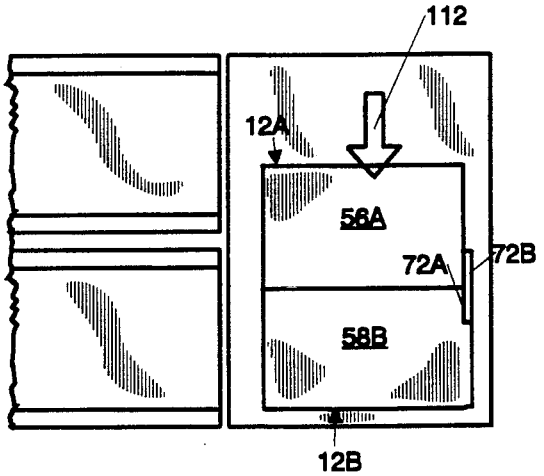

Referring now to FIG. 13, the leading surfaces of the carton components are preferably coplanar aligned, by being pressed against a stop rail or stop surface not shown in the drawings, so that the connecting tabs 72 and the top closure panel 76 of the cartons are coplanar aligned. Thereafter, the cartons are advanced toward one another so that the connecting tabs overlay the other carton component in the manner indicating in FIG. 1, for example. It is generally preferred that one carton component be supported during the marrying of the carton components. For example, as illustrated in FIG. 14, carton component 12*b* is maintained in a stationary position, in contact with guide rails not shown in the drawings, while the remaining carton component 12*a* is advanced thereto in the direction of arrow 112. Depending upon the type of adhesive used, it may or may not be required to clamp the connecting tabs 72 in contact with the mating top closure panel 76 during an 25 adhesive set-up time.

As shown in FIGS. 10–14, the top closure flaps of each carton component are preferably pre-folded so as to form a self-supporting object with the top closure flap 76 and 78 being aligned in planes defined with respect to their sidewalls, so as to facilitate automated handling and the particular marrying of the cartons in an efficient, automated step. Further, it has been found advantageous when securing connecting tabs to top closure flaps 76, that the top closure flaps be folded to a self-supporting position as indicated in FIG. 14 for example, so as to eliminate the need for additional tooling to provide backing support for the top closure flaps 76.

The present invention also contemplates an alternative embodiment wherein the connecting tabs 72 are placed underneath the top closure flaps 76 of an adjacent carton, thus being joined to the underneath surface of the top closure flaps, rather than their upper, exposed surface. Accordingly, a twin package carton is produced having a relatively smooth continuous upper surface. For example, referring to FIG. 17, a carton 110 has connecting tabs 72*a*, 72*b* located underneath top closure flaps 76*b*, 76*a*, respectively. Thus regardless of which embodiment is employed, the connecting tabs and top closure flaps may be said to be in overlapping relationship. It may be advantageous in some automated carton handling environments, that the overlapping relationship of top closure flaps and connecting tabs be such that the connecting tabs are located underneath the top closure flaps. However, certain cost savings and simplified material handling is possible if the overlapping relationship of top closure flaps and connecting tabs is such that the connecting tabs are located to overlie the top closure flaps. Of course, it is possible for a particular twin pack carton, to have one connecting tab underneath its adjacent top closure flap, and the other connecting tab located on top of its adjacent top closure flap.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Carton apparatus, comprising: first and second compartment members each having a plurality of sidewalls, bottom flaps and top flaps and defining a substantially enclosed interior volume;

said first and second compartment members each comprising a tab extending from at least one said top flap and joined to the at least one said top flap with a line of weakness so as to be manually severable therefrom;

the tab of one of said compartment members in overlapping relationship with a top flap of the other of said compartment members and secured thereto with securement means; and the lines of weakness of the first and second compartment members being aligned end-to-end.

2. The apparatus of claim 1 wherein the lines of weakness of the first and second compartment members are colinearly aligned.

3. The apparatus of claim 1 wherein the top flap of each compartment member which is joined to one of the tabs of a respective compartment member is also joined to a first of said sidewalls of the same respective compartment member in overlapping relationship with the one tab, and the first sidewalls of the first and second compartment members are in substantial contact with one another.

4. The apparatus of claim 1 wherein the carton apparatus has a top end, defining an interior volume at the top end and has two opposing top closure means extending from an opposing pair of said sidewalls of the carton apparatus with the top closure means cooperating to enclose the interior volume at the top end of the carton apparatus, each top closure means including compartment member top flaps joined together by a tab.

5. The apparatus of claim 1 wherein the tab of one of said compartment members overlies a top flap of the other of said compartment members.

6. The apparatus of claim 1 wherein the tab of one of said compartment members underlies a top flap of the other of said compartment members.

7. A method of making a multi-compartment separable carton apparatus comprising the steps of:

providing first and second compartment members, each with a plurality of sidewalls, bottom flaps and top flaps and defining a substantially enclosed interior volume;

providing each of the first and second compartment members with a tab extending from at least one top flap and joining the tab to the at least one top flap with a line of weakness so as to be manually severable therefrom;

arranging the first and second compartment members so that the tabs of respective compartment members extend toward the other compartment member and so that at least some of the sidewalls of the first and second compartments are mutually opposing;

bringing the mutually opposing sidewalls of the first and second compartment members adjacent one another so that the tabs of respective compartment members are in overlapping relationship with the other compartment member; and securing the tabs of the respective compartment members to the other compartment member so as to join the two compartment members together along the lines of weakness to form said carton apparatus.

8. The method of claim 7 wherein the top flaps of the first and second compartment members are positioned prior to the securing step so that the tabs are coplanar aligned with one another.

9. The method of claim 8 further comprising the step of aligning the lines of weakness end-to-end so that the compartment members are severable from one another with a continuous motion.

10. The method of claim 9 wherein the lines of weakness are colinearly aligned.

11. The method of claim 7 wherein the step of arranging the first and second compartment members comprises:

sequentially forming the first and second compartment members with similar orientations;

rotating one of the compartment members so as to face the tab thereof in an opposite direction from its initial direction; and moving at least one of the compartment members so as to bring the first and second compartment members into side-by-side relationship.

12. The method of claim 7 wherein at least one of the tabs of a respective compartment member overlies the other compartment member.

13. The method of claim 7 wherein at least one of the tabs of a respective compartment member underlies the other compartment member.

* * * * *

UNITED STATES PATENT AND TRADEMARK OFFICE

CERTIFICATE OF CORRECTION

PATENT NO. : 5,197,660

DATED : March 30, 1993

INVENTOR(S) : Colling

It is certified that error appears in the above-identified patent and that said Letters Patent is hereby corrected as shown below:

ON THE TITLE PAGE:

[63] Related U.S. Application Data, change "765,851" to --756,851--.

[52] U.S. Class, change "22.9" to --229--.

[56] References Cited - U.S. PATENT DOCUMENTS, for the Risucci reference, change "3,315,457" to --3,135,457--.

Column 2, line 48, after "members" delete the comma.

Column 6, line 51, delete "25".

Column 7, line 5, after "Thus" insert a comma.

Signed and Sealed this

Fourth Day of January, 1994

*Attest:*

Bruce Lehman

BRUCE LEHMAN

*Attesting Officer*

*Commissioner of Patents and Trademarks*